US005570894A

United States Patent [19]

Brandner

[11] Patent Number: 5,570,894

[45] Date of Patent: Nov. 5, 1996

[54] DEVICE FOR LINEAR SKATE PREVENTING UNDESIRABLE SHIFTING OF WHEEL SUPPORT

[75] Inventor: Ernest E. Brandner, Couderay, Wis.

[73] Assignee: Jeannette L. Brandner, Couderay, Wis.

[21] Appl. No.: 452,651

[22] Filed: May 25, 1995

[51] Int. Cl.[6] ..... A63C 17/04

[52] U.S. Cl. ..... 280/11.22; 280/11.27; 411/531

[58] Field of Search ..... 280/11.22, 11.26, 280/11.27, 11.28, 11.3, 11.19; 411/973, 531, 539, 169

[56] References Cited

U.S. PATENT DOCUMENTS

| | | | |
|---|---|---|---|
| 114,398 | 5/1871 | Borein | 280/11.28 |
| 134,781 | 1/1873 | Williams | 411/973 |
| 172,805 | 1/1876 | Webster | 411/973 |
| 609,325 | 8/1898 | Boasso | 411/973 |
| 4,586,846 | 5/1986 | Kellison . | |
| 4,619,559 | 10/1986 | Norris | 411/531 |
| 5,046,746 | 9/1991 | Gierveld | 280/11.22 |
| 5,082,230 | 1/1992 | Chang | 248/476 |
| 5,092,614 | 3/1992 | Malewicz | 280/11.22 |
| 5,385,356 | 1/1995 | Conte | 280/11.22 |
| 5,452,907 | 9/1995 | Meibock et al. | 280/11.22 |

FOREIGN PATENT DOCUMENTS

| | | | |
|---|---|---|---|
| 405196176 | 8/1993 | Japan | 411/531 |

*Primary Examiner*—Eric D. Culbreth
*Assistant Examiner*—Min Yu
*Attorney, Agent, or Firm*—Julian C. Renfro, Esq.

[57] ABSTRACT

A novel square washer for use in a linear skate that utilizes an elongate, channel-shaped structural member for supporting a plurality of longitudinally aligned wheels. Such a channel member is adapted to be mechanically affixed to a spaced pair of threaded fastening means extending from the underside of a boot, and the channel member has a pair of orthogonally disposed mounting slots therein, whose position corresponds to the position of the threaded fastening means of the boot. This square washer has first and second sides placed in an opposed relationship, as well as opposed third and fourth sides disposed in an orthogonal relationship to the first and second sides. A centerline extends between the mid points of the first and second sides, and a hole is located on the centerline in an equidistant relationship to the third and fourth sides, with the hole being located closer to the first side than to the second side. When this novel washer is utilized in the channel member, placed upon the fastening means extending through a mounting slot, it effectively serves to prevent an undesirable shift of position of the channel member with respect to the boot. This novel washer is typically utilized in pairs, and because each washer can be placed in the channel member in three different orientations, a total of nine different positions of the channel member with respect to the boot are possible.

7 Claims, 3 Drawing Sheets

DEVICE FOR LINEAR SKATE PREVENTING UNDESIRABLE SHIFTING OF WHEEL SUPPORT

FIELD OF THE INVENTION

This invention relates to a roller skate of the so-called in-line or tandem type, and more particularly to a rollerblade type skate utilizing an adjustably mounted channel-shaped structural member fastened to the underside of a boot or shoe, which member supports the wheels of the skate in a spaced array.

RELATIONSHIP TO OTHER INVENTION

This invention bears a relationship to my allowed patent application entitled "SKATE HAVING ANGULARLY MOUNTED WHEELS," Ser. No. 07/941,947, upon which a Notice of Allowance was mailed May 14, 1993.

BACKGROUND OF THE INVENTION

Almost all skaters are aware of the newly-introduced linear skates, also known as rollerblades, that involve a single row of wheels supported in aligned relation, for such skates permit much greater freedom of motion for the skater than was possible utilizing the quad skate of old.

One particularly popular support for the linear array of skate wheels involves a channel-shaped structural member that is adapted to be mechanically affixed to the underside of a boot or shoe. The boot or shoe typically has one or a pair of mounting locations under the ball of the foot, and a single mounting location at the heel portion of the boot. Each of these mounting locations can involve either a short threaded stud protruding from the sole of the boot or shoe, or else involve a tapped hole intended to receive a threaded bolt. By suitable tightening of the nut used with each threaded stud, or else by tightening of the bolt into each tapped hole, the channel-shaped structural member can be secured tightly to the boot or shoe.

The Kukulowicz U.S. Pat. No. 3,900,203 entitled "Tandem Wheeled Roller Skate" shows a type of wheel support generally similar to the channel-shaped structural member I utilize for supporting the wheels of my skate.

The channel-shaped structural member utilized in accordance with my invention has an elongate base portion of constant width, and side members in a symmetrical relation to the base portion, with each side member forming approximately a right angle with the base portion. By placing a series of holes in a spaced relation along each side member, a plurality of wheel-supporting axles can be inserted into these holes, so as to provide a proper support for the linear array of wheels.

Either two or three holes are placed in a spaced-apart relationship in the base portion of the channel member, with the spacing of these holes coinciding with the spacing of the threaded fastening means utilized to secure the channel member to the boot or shoe. Inasmuch as the skater may from time to time desire to reposition the channel-shaped structural member with respect to the boot, it is typical to provide holes in the base portion of the channel-shaped member that are elongate in a direction orthogonal to the longitudinal centerline of the channel-shaped member. Then, after these holes are placed over the threaded studs protruding from the sole of the boot, a suitable nut is threaded over each stud, and then tightened to hold the channel-shaped member in the position corresponding to the desired relationship to the sole of the boot. As an alternative to this arrangement, when threaded holes are disposed in the sole of the boot, suitably headed bolts are inserted through the elongate holes in the base portion and then tightened at such time as the elongate holes have been moved to the desired relationship to the sole of the boot, and the bolts.

Although the nut applied to the threaded stud, or the bolts used with the threaded holes are tightened in what seemingly is a very secure manner, it is not at all unusual for the channel-shaped structural member to shift its position with respect to the sole of the boot or shoe, this being possible because of the desired use of the holes elongate in the direction at right angles to the longitudinal centerline of the channel member. A shift of position of the channel member may well have a very adverse affect on the skater's performance.

It is in an effort to overcome this problem that the present invention was designed.

SUMMARY OF THE INVENTION

As will afterward be described in substantial detail with respect to the drawings of this case, this invention involves a wheel mounting arrangement for a linear skate involving the use of an elongate, channel-shaped structural member adapted to be mechanically affixed to either two or three threaded fastening means extending in a spaced relationship from the underside of a boot. The channel member comprises an elongate base portion of constant width, along each edge of which a side member extends, with these side members being in a symmetrical relationship to the base portion, and with each side member forming approximately a right angle with the base portion.

A series of holes are located in a spaced relationship along each of the side members of the channel-shaped member, with the holes in one side member being in alignment with the holes in the other side member. This series of aligned pairs of holes thus forms a highly satisfactory support means for enabling a series of wheel-supporting axles to be mounted upon the channel member in a parallel relationship. The wheels disposed upon these axles are of course disposed in a spaced linear array, and spaced apart a sufficient distance to prevent undesired contact between adjacent wheels.

It is well known to dispose two or three wide holes or slots in a spaced apart relationship in the base portion of the channel member, with the spacing of these holes or slots coinciding with the spacing of the threaded fastening means associated with the sole of the boot or shoe. It is also well known to configure these holes or slots in the base portion so that each is elongate in a direction orthogonal to the longitudinal centerline of the channel-shaped member. Because of the use of holes or slots arrayed in this manner, the skater is able to quickly move the channel member away from the longitudinal centerline of the sole of the boot or shoe for a desired extent, and into a selected non-symmetrical relationship with the centerline of the boot or shoe. This relationship of the channel member to the boot or shoe may be preferred in order to permit turning or other maneuvers to be carried out, or it may be utilized by some skaters in order to accommodate a particular type of foot motion utilized by the skater.

Unfortunately, despite the best efforts to tighten the conventional threaded fastening means so as to prevent slippage, the channel-shaped member frequently moves away from the desired relationship to the boot or shoe, to the disadvantage of the skater. In order to prevent such undesirable slippage occasioned by the fact that orthogonally disposed slots are utilized, a novel square washer member is advantageously provided in accordance with this invention.

This novel square washer has sides that are slightly less wide than the dimension across the base portion or bottom member of the channel member, and quite importantly, the washer member has a single offset hole therein, of a diameter slightly greater than the diameter of the threaded fastening means to be utilized for securing the channel member to the underside of the boot or shoe. When the user places this novel square washer upon the threaded fastening means in a desired orientation, it serves as a positive means for preventing the channel member from shifting with respect to the boot, along one of the orthogonally disposed elongate holes or slots utilized in the channel member.

The degree of offset of the single hole utilized in my novel square washer is carefully related to the width of the elongate slot utilized in the base portion of the channel member, so that when the washer is placed in one orientation with respect to the threaded fastening means, it serves to hold the fastening means in one end of the respective elongate hole or slot in the base portion. As an alternative, the washer can be turned 180° from its initial orientation, and in this latter instance, the washer serves to hold the fastening means in the opposite end of the respective elongate hole or slot in the base portion.

As another alternative, the square washer may be placed in the base portion of the channel member in such an orientation that the single hole utilized in the washer serves to hold the fastening means in the center of the elongate hole, thus assuring that the channel member is held in a symmetrical relationship to the longitudinal centerline of the boot or shoe. As is therefore obvious, there are three distinct orientations for the square washer utilized with each elongate hole or slot. When considered that a square washer may be utilized in conjunction with a pair of elongate holes, that is, the elongate holes utilized in the fore and aft locations of the channel member, it is obvious that the user can make use of nine separate orientations of the pair of novel square washers.

Because my novel washer of lightweight material utilizing a single offset hole can be used in multiple orientations, the user can readily employ a pair of these washers in order to hold in the desired relationships to the boot or shoe, the elongate holes utilized in the fore and aft locations of the channel member employed for supporting the wheels of the skate in a linear relationship.

It is therefore a principal object of this invention to provide a low cost, lightweight mechanical device serving to prevent the channel-shaped wheel-supporting member of a linear skate from moving away from a selected relationship to the underside of a boot or shoe.

It is another object of this invention to provide an inexpensive square washer provided with an offset hole, the use of such washer enabling the channel-shaped wheel-supporting member of a linear skate to be reliably maintained in a selected one of a plurality of possible relationships to the underside of a boot or shoe, depending upon the particular positioning of the washer.

It is yet another object of this invention to provide an inexpensive square washer provided with a single offset hole, such washer being able to be installed in any of three separate positions in the channel-shaped wheel-supporting member of a linear skate, thus to cause such channel-shaped member to be reliably maintained in a selected relationship with respect to the underside of a boot or shoe.

It is a more specific object of this invention to provide a novel square washer having a single hole therein disposed in a deliberately offset relationship to the center point of the square washer, with this washer readily assuring that the channel member serving as a support for the linear array of wheels of a rollerblade type skate can be maintained in a position of selected alignment with the underside of the boot or shoe, depending upon the particular orientation of the square washer.

It is still another object of this invention to provide a square washer for use between the sides of a channel member in which the wheels of a linear skate are supported, with an offset hole in the washer enabling it to be installed in any of three different orientations between the sides of the channel member, thus to hold each elongate hole located in the base portion of the channel member in a desired orientation to the longitudinal centerline of the boot upon which the channel member is installed.

It is yet still another object of this invention to provide a square washer whose sides are slightly less wide than the base portion of a channel member in which the wheels of a linear skate are supported, meaning that an offset hole provided in the square washer may be placed in several different orientations, thus to assure by the use of a pair of such washers that the elongate holes utilized in fore and aft locations on the channel member cannot move away from the user-selected relationship to the threaded fastening means utilized on the exterior portion of the sole of a boot or shoe.

It is yet still another object of this invention to provide a novel square washer usable in pairs in conjunction with the channel member utilized for supporting the wheels of a linear skate, to assure that the orthogonally-placed elongate holes utilized in fore and aft locations on the channel member cannot move away from the user-selected relationship to the threaded fastening means of the boot or shoe, with it being possible for the user to effect a rapid reorientation of these washers in order to bring about a relocation of the channel member.

It is yet still another object of this invention to provide a novel square washer usable in pairs in conjunction with the channel member utilized for supporting the wheels of a linear skate on a boot, with each of the square washers being positionable in a desired relationship to the respective orthogonally-placed elongate hole utilized in the base portion of the channel member, with the separately positionable washers making it possible for the user to bring about nine different combinations of washer positions, thus to position the channel member in a wide range of distinct positions with respect to the sole of the boot.

These and other objects, features and advantages will become more apparent as the description proceeds.

DETAILED DESCRIPTION

Figure 1:
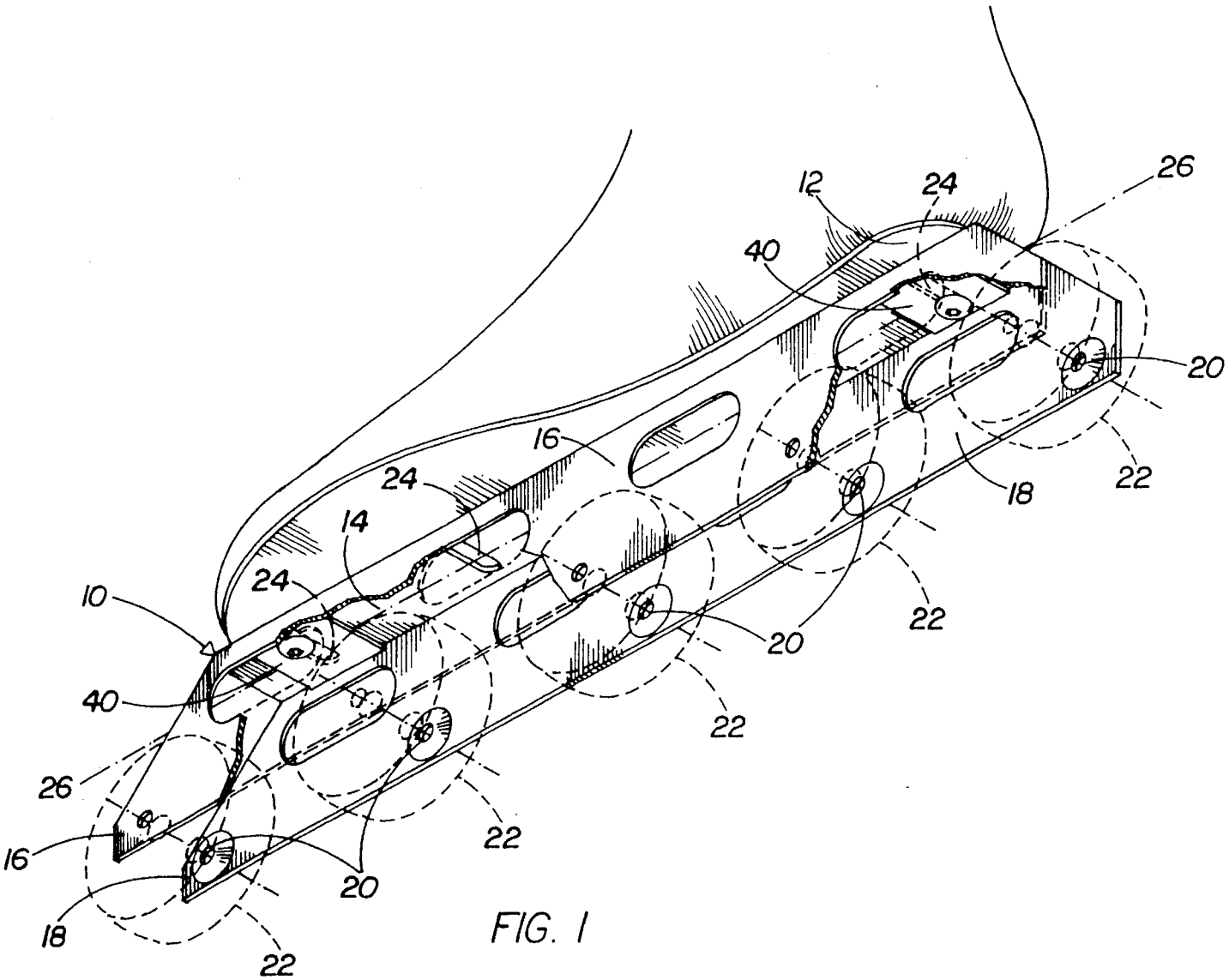
FIG. 1 is a perspective view revealing the relationship of a channel-shaped structural member to the underside of a boot or shoe, with this figure revealing the use of holes in the base portion of the channel member that are elongate in a direction orthogonal to the longitudinal centerline of the channel member, with this figure also showing how the novel square washers provided in accordance with this invention can be utilized for holding the channel member in a desired relationship to the sole of the boot or shoe.

With initial reference to FIG. 1, it will be seen that this is a perspective view revealing the relationship of a channel-shaped structural member 10 utilized for supporting, in an essentially conventional manner, a linear array of wheels of a rollerblade-type skate in a firm relationship to the underside of a boot or shoe 12. It will be noted that FIG. 1 reveals that the channel member 10 has a base portion 14, extending away from which in a right angle relationship, are side members 16 and 18; note these side members also in FIG. 3.

In accordance with conventional practice, a series of spaced holes 20 are disposed along the side members, with the holes in one side member being in alignment with the holes disposed in the other side member. It is into these aligned pairs of holes that the wheel-supporting axles of the linear skate are mounted. The wheels 22 are of course supported from such axles in a carefully aligned array, and spaced in such a manner as to avoid one wheel interfering with another.

It is to be noted from FIG. 1 and even more clearly from FIG. 3 that a plurality of holes or slots 24 are provided in the base portion 14 of the channel member 10, and for a reason discussed hereinafter, the holes 24 are elongate in a direction orthogonal to the longitudinal centerline 26—26 of the channel member 10, which centerline bisects the base portion 14. The elongate holes or slots 24 in the base portion 14 are disposed in a carefully spaced relationship such that these holes coincide with the threaded fastening means utilized in an operable relationship to the underside of the boot or shoe 12. As a result of this arrangement, the channel member 10 can be secured in a desired operational relationship to the centerline of the soles of the boot or shoe 12.

Figures 2A, 2B, 3, 4, 5A, 5B, 5C:
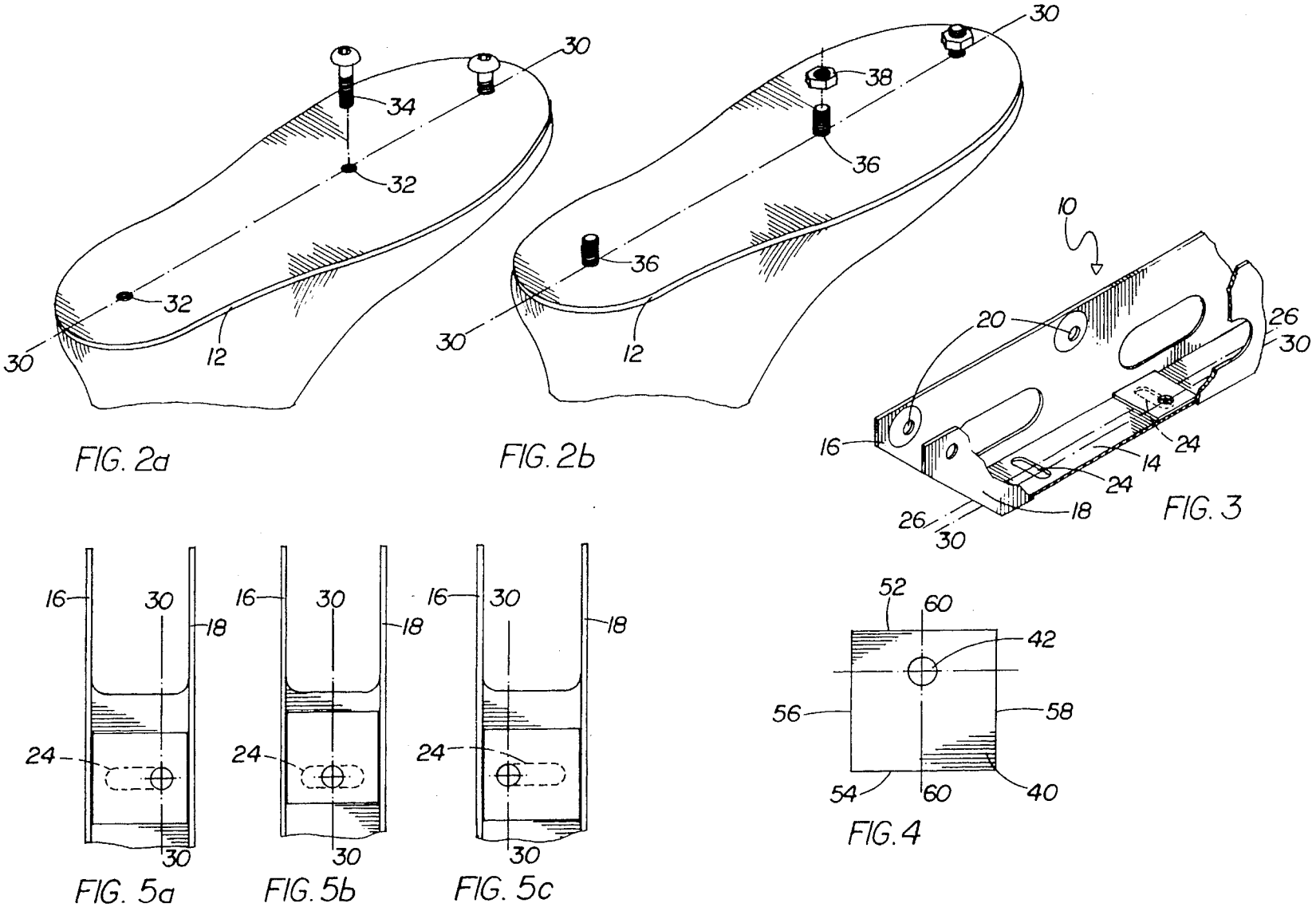
FIG. 2*a* is a view of the sole portion of boot or shoe of the type having threaded holes located along the longitudinal centerline of the sole, so that threaded bolts of a suitable size may be utilized for securing the wheel-supporting channel member to the underside of the boot or shoe.
FIG. 2*b* is a view of the sole portion of boot or shoe of an alternate type, wherein threaded studs protrude upwardly at spaced locations along the centerline of the sole, so that nuts of a suitable size may be utilized for securing the wheel-supporting channel member to the underside of the boot or shoe.
FIG. 3 is a fragmentary perspective view of the channel member with which my novel square washer is utilized, with the channel member in this instance being disposed in an inverted position in order to reveal the placement of the pair of elongate holes or slots utilized in the forward portion of the channel member.
FIG. 4 is a view of a preferred embodiment of my novel square washer, utilizing a single offset hole.
FIGS. 5*a* through 5*c* illustrate various orientations of the single offset hole of the square washer, utilized in order to hold the channel member on the centerline of the shoe, or else to hold the channel member to one or the other sides of the centerline of the shoe.

As will be seen by referring to FIGS. 2*a* and 2*b*, the threaded fastening means utilized for holding the channel member 10 and therefore the wheel assembly of the linear skate to the sole of the boot or shoe can involve two or three threaded holes 32 disposed along the centerline 30—30 of the underside of the boot or shoe 12, as revealed in FIG. 2*a*. As an alternative, the threaded fastening means may involve two or three threaded studs 36 protruding for a short distance from the underside of the boot or shoe along the centerline 30—30 thereof, as revealed in FIG. 2*b*.

In the instance depicted in FIG. 2*a*, by inserting a suitable bolt 34 in each elongate hole or slot 24, the threaded end of the bolt can be caused to engage the respective threaded hole 32 located in the sole of the boot or shoe, which bolt 34 can then be tightened to hold the channel member 10 securely to the boot or shoe. As an alternative to this arrangement, the previously-mentioned threaded studs 36 depicted in FIG. 2*b* can be caused to extend through the elongate holes 24 of the channel member 10, with a nut 38 thereafter tightly applied to each threaded stud.

By applying a suitable amount of tightening effort to each bolt, or to each nut as the case may be, the channel member 10 is ostensibly held in a non-slip manner to the sole of the boot or shoe 12. Quite unfortunately, this arrangement has been found in practice to be insufficient for holding the channel member in the desired, non-slip relationship to the boot or shoe, largely because of the fact that the holes or slots 24 are deliberately of elongate configuration. By virtue of the holes 24 being elongate in a direction that is at right angles to the longitudinal centerline 26—26 of the channel member 10, the skater has the prerogative of securing the channel member 10 along the centerline 30—30 of the underside of the boot or shoe 12, or to one side or the other of this centerline.

A deliberate non-symmetrical relationship of the channel member 10 to the boot or shoe 12 may be occasioned by the fact that the skater may even wish to move the channel member away from the centerline 30—30 of the sole of the boot or shoe. As a matter of fact, the skater may wish to move one end of the channel member to one side of the centerline of the boot, and the other end of the channel member to the other side of the centerline. A non-symmetrical arrangement of this general type may be preferred in order to permit the skater to undertake a particular type of maneuver, or this non-symmetrical relationship maybe preferred by some skaters in order to accommodate a particular type of foot motion that the skater utilizes.

I have found that some skaters, when skating on small indoor rinks, like to move the channel member 10 toward the inside of the boot, so that the edge of the boot does not rub against the floor during tight turns. Thereafter, when returning to outside use, the channel member can readily be moved to the centerline of the boot, if this is the desired position.

The belts 34 or the nuts 38 utilized for holding the channel member 10 to the underside of the boot may, quite unfortunately, tend to loosen, and permit the channel member 10 to move out of the selected position. It has therefore been necessary in accordance with current practice for the skater to frequently stop in order to retighten the bolts or the nuts utilized for securing the wheel-carrying channel member 10 to the sole of the boot or shoe 12. This need to periodically retighten is of course a distinct disadvantage to the skater.

In order to combat this tendency, I have provided in accordance with this invention, a novel substantially square washer 40. A pair of washers 40 are to some extent visible in FIG. 1, for typically my washers are utilized in pairs. In FIG. 4 I show my novel square washer 40 in enlarged detail. As seen in this latter figure, I utilize a single hole 42 in the square washer 40, which hole 42 is deliberately placed in an offset relationship to the center of the square washer 40, for a reason soon to be apparent. Importantly, the sides of the square washer 40 are of a dimension slightly less wide than the width of the base portion 14 of the channel member 10. This of course means that the washer 40 cannot turn or rotate in the channel member 10, and that the hole 42 of the washer may be disposed in several different relationships in the channel member with respect to one of the elongate holes 24 located in the base portion 14 of the channel member. This novel square washer 40, when its hole 42 is placed upon a threaded mechanical device while the washer is residing between the side members 16 and 18, serves in a highly advantageous manner to prevent the channel member 10 from shifting along one of the elongate holes 24 with respect to the boot. Because I need to utilize only a single offset hole 42 in the washer 40, this washer can be produced at very low cost.

The amount of offset of the hole 42 in the square washer 40 is to some extent governed by the dimensions of the elongate holes 24, for as shown in FIG. 5*a*, in one instance it may be desirable to secure the threaded fastening means at or near the right hand end of the elongate slot 24, or in other words, to cause the threaded fastening means to reside relatively close to the side member 16. This of course causes a principal portion of the channel member 10 to be located somewhat to the left of the longitudinal centerline 30—30 of the boot or shoe. As an alternative, the square washer 40 may be reoriented 90° from the position shown in FIG. 5*a*, such that the single hole 42 of the washer is centered midway between the side members 16 and 18 of the channel member 10. In this way, the threaded fastening means are caused to remain along the longitudinal centerline 26—26 of the channel member 10, and the centerlines 26—26 and 30—30 are coincident; note FIG. 5*b*.

As another alternative, the square washer 40 may be turned 180° from the position shown in FIG. 5*a*, so that the single non-symmetrically disposed hole 42 is placed so as to cause the threaded fastening means to reside in the elongate hole or slot 24 near the side member 18, in the manner shown in FIG. 5*c*. This of course causes the principal portion of the channel member 10 to be located somewhat to the right of the centerline 30—30 of the boot or shoe.

It is thus to be seen that each washer 40 of a pair of square washers may be disposed in any of three significantly different orientations. Thus each washer is able to hold the respective end of the channel member 10 in a desired relationship to the centerline 30—30 of the boot or shoe upon which the member 10 is mounted. Because I prefer to utilize a square washer 40 at both the fore and the aft locations on the channel member 10, nine different positions of the channel member 10 are possible on each boot or shoe.

My novel square washer 40 is preferably of metal, and can be highly effective even though it is something on the order of only 0.032 thickness. Because all four sides are of equal size, the skater can readily place the washer in any of the orientations depicted in FIGS. 5*a* through 5*c*. However, in no instance can the washer rotate while residing between the sides of the channel member 10.

As revealed in FIG. 4, each square washer may be regarded as having first and second sides 52 and 54 placed in an opposed relationship, as well as opposed third and fourth sides 56 and 58 disposed in an orthogonal relationship to the first and second sides. The centerline 60—60 may be regarded as extending between the mid points of the first side 52 and the second side 54, with the single hole 42 in the square washer being located on the centerline, thus in an equidistant relationship to the third and fourth sides. Because of the arrangement I utilize, the hole 42, as seen in FIG. 4, is closer to the first side 52 than to the second side 54. In other words, the hole 42 may be regarded as disposed in an offset relationship.

In most instances, the threaded holes 32 in the sole of the shoe are intended to receive a ¼ inch bolt, but in some instances 5/16 inch bolts may be utilized. Similarly, the threaded studs 36 mounted along the centerline 30—30 of the sole of the shoe are usually ¼ inch in diameter, but these can be of 5/16 inch diameter.

As is obvious, the elongate holes 24 are of a dimension such as to receive the 5/16 inch fastening means, and the hole 42 in the square washer 40 is likewise of a size that a 5/16 inch fastening means can be received.

It was previously pointed out that because the washer 40 is of comparatively thin construction and requires only a single offset hole, it can be produced at very low cost, and utilized with a wide range of linear skates utilizing a channel member for supporting the linear array of wheels. The washer 40 is preferably made of aluminum, but in some instances may be made of an industrial grade plastic.

Figure 6:
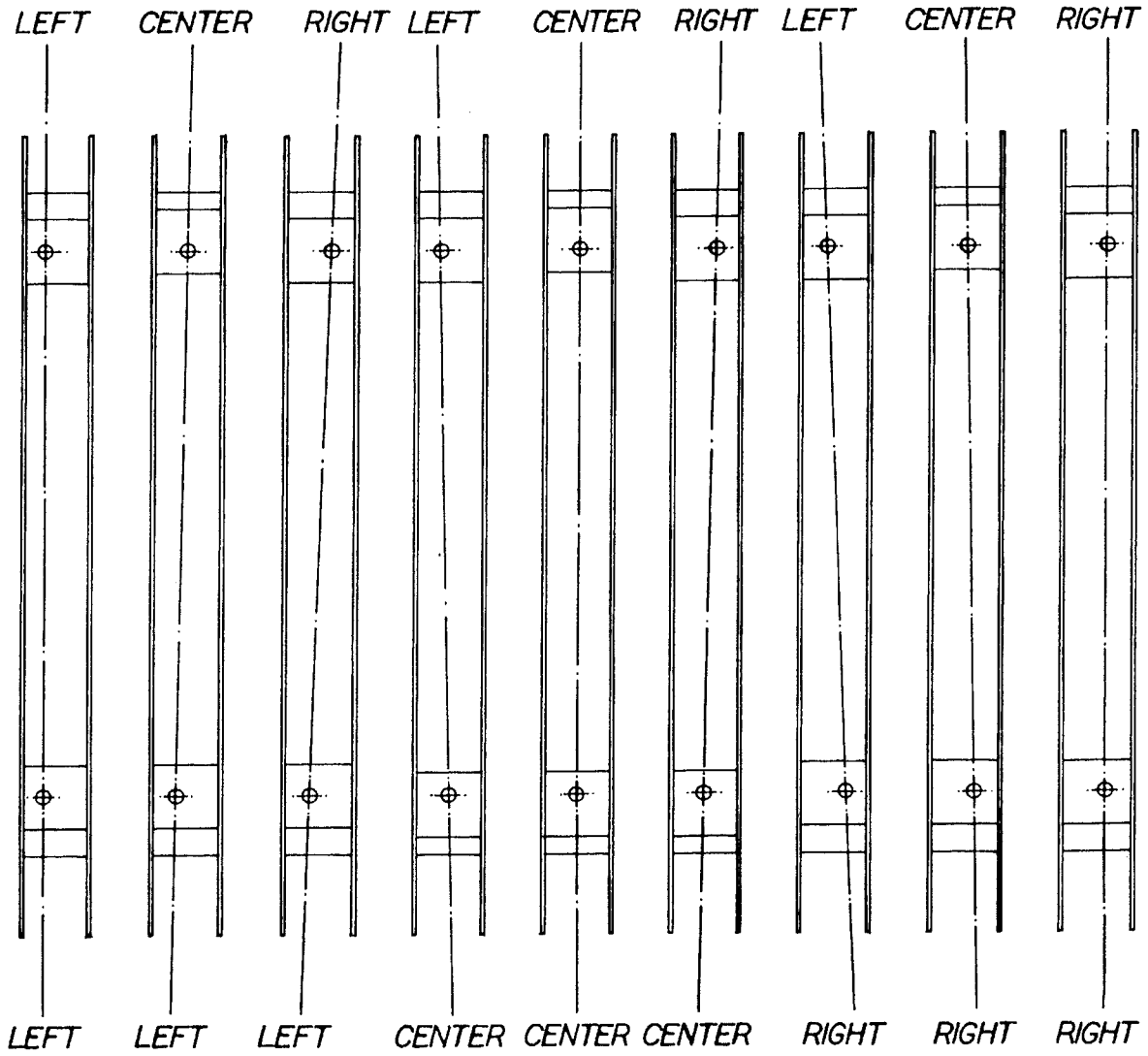
FIG. 6 is a diagrammatic showing of how a pair of my novel square washers can be utilized for bringing about nine different positionings of the channel member with respect to the sole of the boot or shoe.

With reference now to FIG. 6, it will be seen that I have here diagrammatically indicated how, by the use of a pair of my novel square washers, the user can achieve nine different positionings of the channel member with respect to the centerline of the boot or shoe upon which the skate is mounted.

More specifically, in the part of FIG. 6 corresponding to the first three positions, the offset hole in the lower square washer is in the left position in each instance, whereas the hole in the upper square washer is respectively in the left, center and right positions.

In the center three positions in FIG. 6, the offset hole in the lower square washer is in the center position in each instance, whereas the hole in the upper square washer is respectively in the left, center and right positions.

In the three positions depicted at the right side of FIG. 6, the offset hole in the lower square washer is in the right hand position in each instance, whereas the hole in the upper square washer is respectively in the left, center and right positions.

As should now be clear by the use of a pair of my novel square washers on each skate, the user can achieve a wide variety of channel positionings with respect to the centerline of the boot or shoe upon which the skate is mounted.

I claim:

1. A linear skate utilizing an elongate, channel-shaped structural member for supporting a plurality of longitudinally aligned wheels, said channel-shaped member being adapted to be mechanically affixed to a spaced pair of threaded fastening means extending from the underside of a boot, said channel member comprising an elongate base portion of constant width, along each edge of which a side member extends, said side members forming approximately a right angle with said base portion, and said side members having spaced holes therein for supporting a plurality of wheels disposed in a spaced relationship along the longitudinal centerline of said base portion, at least two mounting holes disposed in a spaced apart relation in said base portion, with the spacing of said mounting holes substantially coinciding with the spacing of the threaded fastening means utilized with the boot, each of said mounting holes in said base portion being elongate in a direction orthogonal to the longitudinal centerline of said base portion, and a square washer having sides slightly less wide than the dimension across said base portion of said channel member, said washer having an offset hole therein, of a diameter slightly greater than the diameter of the threaded fastening means operatively associated with the boot, said square washer, when said offset hole has been placed over a threaded fastening means and said washer then held in place by the fastening means, serving to effectively prevent said channel member from shifting away from a desired relationship to the boot, along the respective elongate hole.

2. The linear skate utilizing an elongate, channel-shaped structural member for supporting a plurality of longitudinally aligned wheels as recited in claim 1 in which said square washer has first and second sides placed in an opposed relationship, as well as opposed third and fourth sides disposed in an orthogonal relationship to said first and second sides, a centerline extending between the mid points of said first and second sides, said hole being located on said centerline in an equidistant relationship to said third and fourth sides, said hole being located closer to said first side than to said second side.

3. The linear skate utilizing an elongate, channel-shaped structural member for supporting a plurality of longitudinally aligned wheels as recited in claim 1 in which said washer, because of its square configuration, being able to be positioned by a user in any of three meaningful positions, with each washer position causing a different relationship of an adjacent portion of said channel member to the respective fastening means.

4. The linear skate utilizing an elongate, channel-shaped structural member for supporting a plurality of longitudinally aligned wheels as recited in claim 1 in which said washer, because of its square configuration, being able to be positioned by a user in any of three meaningful positions, said washers being used in pairs, with one washer of the pair able to be in a different orientation with respect to the channel member than the other washer of the pair, with the separately positionable washers making possible nine different positionings of the channel member with respect to the underside of the boot.

5. A linear skate utilizing an elongate, channel-shaped structural member for supporting a plurality of longitudinally aligned wheels, said channel-shaped member being adapted to be mechanically affixed to a spaced pair of threaded fastening means extending from the underside of a boot, said channel member comprising an elongate base portion of constant width, along each edge of which a side member extends, said side members forming approximately a right angle with said base portion, and said side members having spaced holes therein for supporting a plurality of wheels disposed in a spaced relationship along the longitudinal centerline of said base portion, at least two mounting holes disposed in a spaced apart relation in said base portion, with the spacing of said mounting holes substantially coinciding with the spacing of the threaded fastening means utilized with the boot, each of said mounting holes in said base portion being elongate in a direction orthogonal to the longitudinal centerline of said base portion, and a pair of square washers, with each washer having sides slightly less wide than the dimension across said base portion of said channel member, each of said washers having an offset hole therein, of a diameter slightly greater than the diameter of the threaded fastening means operatively associated with the boot, each square washer, when its offset hole has been placed over a respective threaded fastening means and the washer then held in place by the fastening means, serving to effectively prevent a respective part of said channel member from shifting away from a desired relationship to the boot, along the respective elongate hole.

6. The linear skate utilizing an elongate, channel-shaped structural member for supporting a plurality of longitudinally aligned wheels as recited in claim 5 in which each of said square washers has first and second sides placed in an opposed relationship, as well as opposed third and fourth sides disposed in an orthogonal relationship to said first and second sides, a centerline extending between the mid points of said first and second sides, said hole being located on said centerline in an equidistant relationship to said third and fourth sides, said hole being located closer to said first side than to said second side.

7. The linear skate utilizing an elongate, channel-shaped structural member for supporting a plurality of longitudinally aligned wheels as recited in claim 5 in which each washer, because of its square configuration, being able to be positioned by a user in any of three meaningful positions, with each washer position causing a different relationship of an adjacent portion of said channel member to the respective fastening means.

* * * * *